US011820142B2

(12) United States Patent
Kusano et al.

(10) Patent No.: US 11,820,142 B2
(45) Date of Patent: Nov. 21, 2023

(54) ELEMENT SUBSTRATE, LIQUID DISCHARGE HEAD, AND MANUFACTURING METHOD OF SAME

(71) Applicant: CANON KABUSHIKI KAISHA, Tokyo (JP)

(72) Inventors: Hiroaki Kusano, Tokyo (JP); Junichiro Iri, Kanagawa (JP); Yusuke Hashimoto, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 48 days.

(21) Appl. No.: 17/708,711

(22) Filed: Mar. 30, 2022

(65) Prior Publication Data

US 2022/0314618 A1 Oct. 6, 2022

(30) Foreign Application Priority Data

Apr. 6, 2021 (JP) ..... 2021-064778

(51) Int. Cl.
*B41J 2/14* (2006.01)

(52) U.S. Cl.
CPC ..... *B41J 2/14072* (2013.01); *B41J 2/14024* (2013.01); *B41J 2002/14185* (2013.01)

(58) Field of Classification Search
CPC ..... B41J 2/14072; B41J 2/14024; B41J 2002/14185; B41J 2/1603; B41J 2/1623; B41J 2/1629; B41J 2/1631; B41J 2/1643; B41J 2/1645; B41J 2/1404
See application file for complete search history.

(56) References Cited

U.S. PATENT DOCUMENTS 8,007,076 B2 8/2011 Ono
8,858,812 B2 * 10/2014 Furusawa ..... B41J 2/1603 216/37
2009/0002453 A1 1/2009 Ono

FOREIGN PATENT DOCUMENTS

JP 4994968 B2 8/2012

* cited by examiner

*Primary Examiner* — Lisa Solomon
(74) *Attorney, Agent, or Firm* — VENABLE LLP

(57) ABSTRACT

An element substrate used in a liquid discharge head that discharges liquid to a recording material includes a substrate, an energy generating element that generates energy used to discharge the liquid, circuit wiring that has an electrode portion for external electrical connection and that drives the energy generating element, and that is implemented on the substrate, a first protective film layer that has an opening portion for exposing the electrode portion and that covers the circuit wiring, an electroplating ground layer formed on the electrode portion, and an electroplated bump layer made of a metal material formed on the electroplating ground layer. A bent portion is formed in the first protective film layer by the first protective film layer covering a protruding portion that the circuit wiring has. A second protective film layer is formed on the first protective film layer and covers the bent portion.

12 Claims, 10 Drawing Sheets

ELEMENT SUBSTRATE, LIQUID DISCHARGE HEAD, AND MANUFACTURING METHOD OF SAME

BACKGROUND OF THE INVENTION

Field of the Invention

The present invention relates to an element substrate, a liquid discharge head, and a manufacturing method of the same.

Description of the Related Art

Ink jet recording apparatuses (hereinafter, referred to simply as "recording apparatus") have features such as being capable of high-density and high-speed recording on various types of recording media, making little noise when recording, and so forth. As a representative ink discharge method by ink jet recording heads (hereinafter, referred to simply as "recording head") mounted in such recording apparatuses, there is known an arrangement in which ink is heated by electrothermal conversion elements having heating resistance elements, and ink droplets are discharge by the effect of film boiling.

In a recording head that uses electrothermal conversion elements, the electrothermal conversion elements are provided in recording liquid chambers. Electric pulses that serve as recording signals are supplied to the electrothermal conversion elements which are heated thereby, thermal energy is imparted to ink, and minute ink droplets are discharged from minute discharge orifices using bubble pressure generated from the recording liquid bubbling due to phase change of the recording liquid at this time, thereby performing recording on recording media. The recording head has ink jet recording nozzles for discharging ink droplets, and a supply system for supplying ink to these nozzles.

Manufacturing of a recording head involves a step of electrically connecting a bump on an electrode terminal on a recording element substrate configured having a substrate in which a heater and so forth are formed, and a nozzle-formation material, with an electrode lead (hereinafter, simply referred to as "lead") of electric wiring tape for electric connection to the apparatus main body. In recent years, the number of nozzles has increased to raise printing speeds, and recording element substrate sizes are becoming smaller in order to increase the number of recording elements substates per wafer to reduce costs. Accordingly, the number of electrode terminals, i.e., the number of bumps disposed per wafer is in an increasing trend. Accordingly, forming each bump individually as with ball bumps, performing leveling to make the height of the bumps uniform, and connecting leads and electrode terminals individually results in long step takt. With regard to this point, electroplated bumps that are formed, with gold being grown by electroplating, enable a plurality of bumps to be formed by batch processing on each wafer, and variance in height of the bumps can be suppressed. As a result, the step takt can be shortened, and accordingly, using electroplated bumps is now mainstream for electrode terminals of recording element substrates.

Japanese Patent No. 4994968 uses gang bonding as a method for connecting to the recording element substrate. In gang bonding, leads are pressure-bonded under heat and pressure in batch fashion, to be joined to electroplated bumps of electrode terminals on the recording element substrate. Accordingly, all leads are bonded by a broad bonding tool, which has a feature in that the work takt for bonding can be made to be approximately the same regardless of the number of leads.

In an assembly method of a recording head including the step of electrically connecting the recording element substrate and the electric wiring tape, electric connection portions are subjected to no small load up to an adhesion fixing step to a base member, which is a subsequent step, due to shock, vibrations, and so forth that occur during conveyance and handling. These items are more noteworthy the further the increase in the size of the recording element substrate, increase in the number of electrode terminals, reduction in size of electrode terminals, and increasingly narrow pitches of electrode terminal rows, advance, and more care must be taken to avoid electric connection defects such as peeling, fracturing, and so forth, from occurring. Examples of methods for preventing electric connection defects such as peeling, fracturing, and so forth include raising bonding conditions, such as bonding tool temperature, shock load applied to the electroplated bumps, and the pressing load, thereby increasing the bonding strength of the electroplated bumps and leads.

SUMMARY OF THE INVENTION

However, in bonding in which electroplated bumps and leads are electrically connected, there have been cases in which applying pressure to the electroplated bumps by the bonding tool ruptures bent portions of a protective film layer on the outer side of the electroplated bumps and forms cracks. Formation of cracks can lead to moisture from ink and so forth intruding into the cracks, and the wiring covered by the protective film layer corroding.

Accordingly, it is an object of the present invention to provide an element substrate, a liquid discharge head, and a manufacturing method of the same, that are capable of suppressing corrosion of wiring due to moisture even if cracks occur in the bent portions of the protective film layer.

Accordingly, an element substrate used in a liquid discharge head that discharges liquid to a recording medium according to the present invention includes:

a substrate;

an energy generating element that generates energy used to discharge the liquid;

circuit wiring that has an electrode portion for external electrical connection and that drives the energy generating element, and that is implemented on the substrate;

a first protective film layer that has an opening portion for exposing the electrode portion and that covers the circuit wiring;

an electroplating ground layer formed on the electrode portion; and an electroplated bump layer made of a metal material formed on the electroplating ground layer, wherein a bent portion is formed in the first protective film layer by the first protective film layer covering a protruding portion that the circuit wiring has, and a second protective film layer is formed on the first protective film layer and covers the bent portion.

According to the present invention, even if cracks occur in the protective film layer formed below a resin film layer (elastic resin film), intrusion of moisture from ink and so forth from the cracks can be prevented by the resin film layer, and the problem of electric wiring film covered by the protective film layer corroding can be prevented.

Further features of the present invention will become apparent from the following description of exemplary embodiments with reference to the attached drawings.

DESCRIPTION OF THE EMBODIMENTS

First Embodiment

An ink jet recording apparatus according to the present invention will be described below. A description of embodiments (examples) of the present invention will be given. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Figure 4:
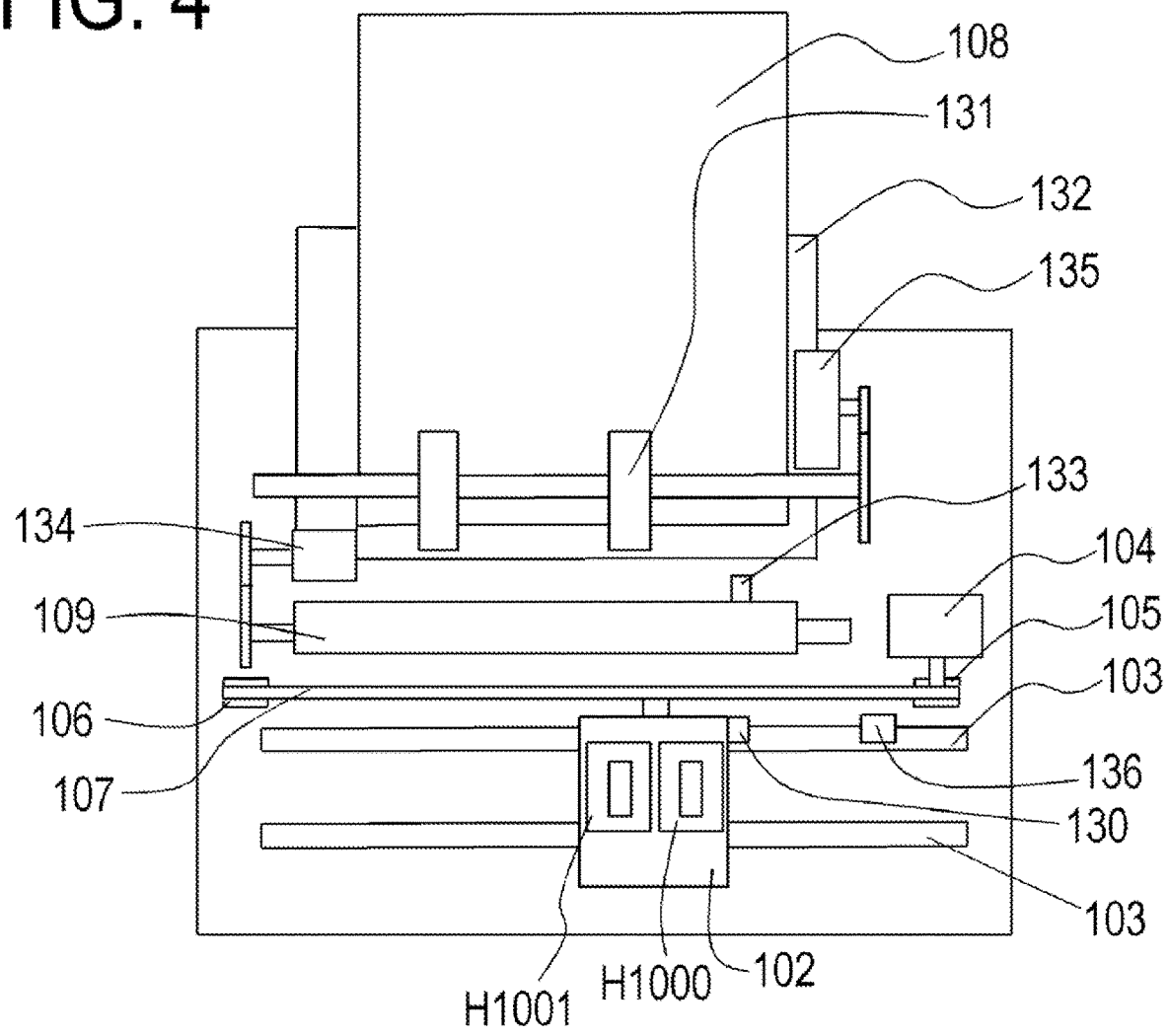
FIG. 4 illustrates an example of an ink jet recording apparatus.

FIG. 4 is a schematic plan view illustrating an example of an ink jet recording apparatus to which the present invention is applicable. This recording apparatus has a carriage 102 to which recording heads H1000 and H1001 are positioned and exchangeably mounted. An electric connection portion for transmitting drive signals and so forth to each of discharge portions via external signal connection terminals on the recording heads H1000 and H1001 is provided to the carriage 102.

The carriage 102 is supported by a guide shaft 103 disposed in an apparatus main body so as to extend in a main scanning direction so as to be capable of reciprocal movement following the guide shaft 103. The carriage 102 is driven by a transmission mechanism including a motor pulley 105, a slave pulley 106, a timing belt 107, and so forth, by a main scanning motor (carriage motor) 104, and the position and movement thereof are controlled thereby. A home position sensor 130 is provided on the carriage 102. A position serving as a home position is detected when the home position sensor 130 on the carriage 102 passes a position of a shielding plate 136.

A recording medium 108, such as paper, thin sheets of plastic, and so forth, serving as recording material, is separated and fed from an automatic sheet feeder (ASF) 132 one sheet at a time, by a sheet feeding motor 135 rotating a pickup roller 131 via gears. Further, the recording medium 108 is conveyed over a position (recording region) facing the faces of the recording heads H1000 and H1001 on which discharge orifices are formed (sub-scanned), by a conveying motor 134 rotating a conveying roller 109 driven via gears. Determination of whether or not a recording medium 108 has been fed, and final determination of a leading edge position of the recording medium at the time of feeding, are performed at the point in time of the recording medium 108 passing a paper end sensor 133. This paper end sensor 133 is also used for determining where the trailing edge of the recording medium 108 actually is, and ultimately determining the current recording position from the actual trailing end. Note that the rear face of the recording medium 108 is supported by a platen (omitted from illustration) so as to form a flat recording face in the recording region. In this case, the recording heads H1000 and H1001 mounted on the carriage 102 are held with the discharge orifice faces thereof protrude downward from the carriage 102 so as to be parallel with the recording medium 108, and main scanning thereof is performed in the recording region.

The recording heads H1000 and H1001 are mounted to the carriage 102 such that the direction of array of discharge orifices in each of the discharge portions is in a direction intersecting the main scanning direction of the carriage 102 (e.g., sub-scanning direction). Recording over a breadth corresponding to a discharge orifice layout range is performed by discharging ink that is a liquid from these discharge orifice rows in the process of main scanning.

The recording heads (liquid discharge heads) according to the present embodiment are configured integrally with ink tanks that are casing storing liquid therein. A first recording head H1000 has an ink storage portion filled with black ink, and a discharge portion for discharging black ink supplied from the ink storage portion. A second recording head H1001 has ink storage portions filled with each color ink (cyan ink, magenta ink, and yellow ink), and discharge portions for discharging color ink supplied from the respective ink storage portions. These recording heads H1000 and H1001 are fixedly supported on the carriage 102 by a positioning unit and electric contacts, and have forms of cartridges that are detachably mountable to the carriage. In a case in which the ink filled therein is consumed and gone, the recording head can be replaced.

Of the recording heads H1000 and H1001 used in the embodiments below, the basic configuration of the color recording head H1001 will be described with reference to FIGS. 5A and 5B to FIG. 7. The recording head H1000 has the same configuration as the recording head H1001 except for being a configuration for the one color of black ink, and accordingly description will be omitted.

Figure 5A:
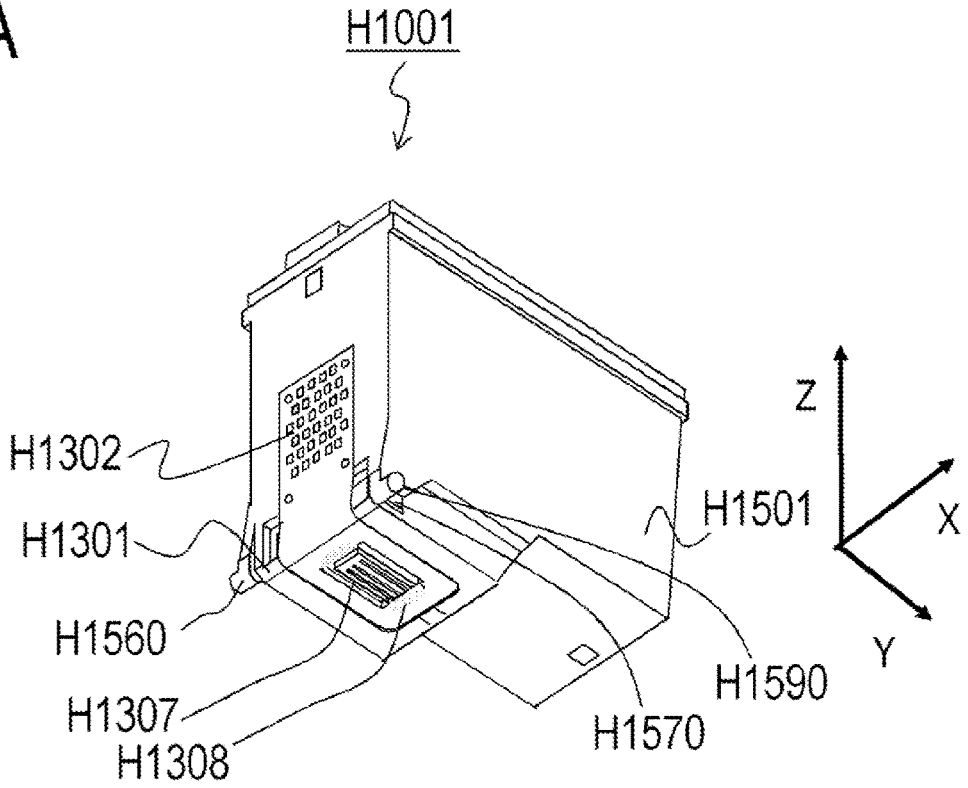
FIGS. 5A and 5B are perspective views illustrating a configuration example of a recording head that can be mounted to the recording apparatus.
Figure 5B:
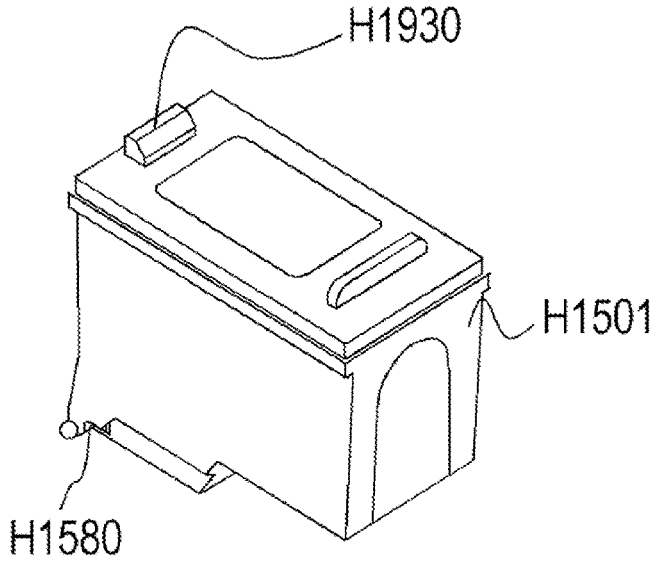

FIGS. 5A and 5B are perspective views illustrating a configuration example of the recording head H1001 that is capable of being mounted to the recording apparatus in FIG. 4. FIG. 5A is a view from an element substrate side, and FIG. 5B is a view from an ink tank side. As illustrated in FIG. 5B, the recording head H1001 has a Y-direction (sub-scanning direction) abutting portion H1580 for positioning at a predetermined fitting position on the carriage and an engaging portion H1930 for fitting and fixing to the carriage by a fixing level (omitted from illustration) provided on the carriage side. The recording head H1001 also is provided with a fitting guide H1560 for guiding to the fitting position of the carriage 102 of the ink jet recording apparatus, an X-direction (main scanning direction) abutting portion H1570, and a Z-direction (vertical direction) abutting portion H1590, for positioning at a predetermined fitting position on the carriage, as illustrated in FIG. 5A. Being positioned on the carriage 102 by these abutting portions enables electric contact between external signal connection terminals H1302 on an electric wiring tape H1301 and contact pins of an electric connection portion provided in the carriage. The recording head H1001 is for discharging ink of the three colors of cyan, magenta, and yellow.

Figure 6A:
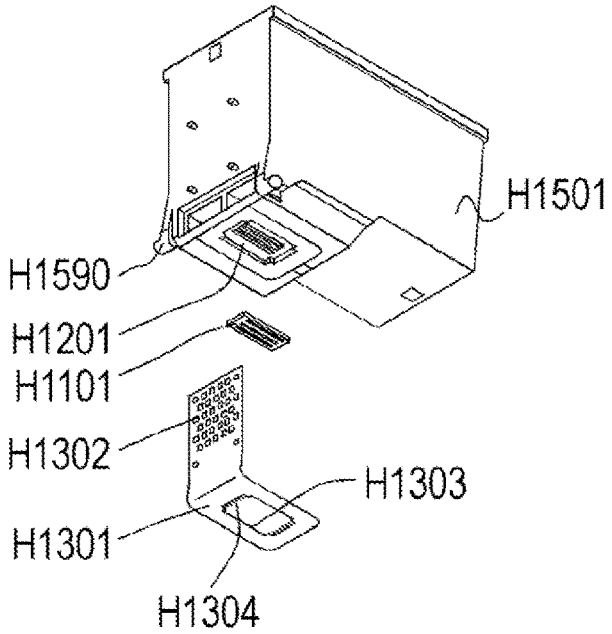
FIGS. 6A and 6B are disassembled views of the recording head.
Figure 6B:
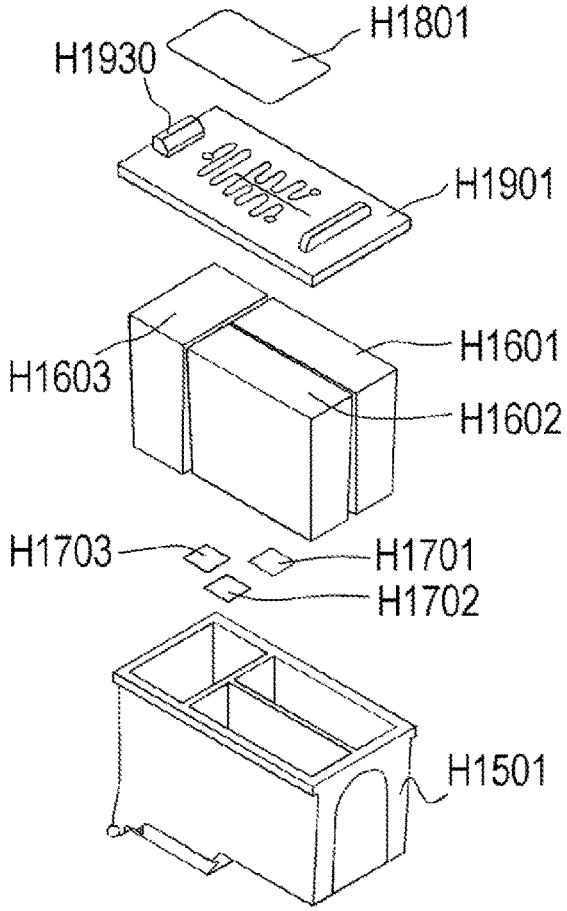

FIGS. 6A and 6B are disassembled perspective views of the configuration example of the recording head H1001. FIG. 6A is a disassembled view of the electric wiring tape (relay wiring portion) H1301, and FIG. 6B is a disassembled view of a main body member H1501. FIGS. 6A and 6B illustrate a configuration including a recording element substrate (element substrate) H1101, the electric wiring tape H1301, the main body member H1501, filters H1701, H1702, and H1703, ink absorbing members H1601, H1602, and H1603, a lid member H1901, and a seal member H1801.

As illustrated in FIG. 6A, an electric signal path for applying electric signals for discharging ink is formed to the recording element substrate H1101. An opening portion H1303 in which the recording element substrate H1101 is assembled is formed in the electric wiring tape H1301, and a lead H1304 connected to an electrode portion H1104 of the recording element substrate H1101 is formed protruding from the edge of the opening portion H1303. The external signal connection terminal H1302 for receiving electric signals from the apparatus main body is formed on the electric wiring tape H1301, and the lead H1304 and the external signal connection terminal H1302 are connected by an electroconductive wiring pattern including continuous copper foil or the like. Tape-automated bonding (TAB) tape is used here to form the electric wiring tape H1301, with the lead H1304 exposed to form a flying lead.

The electric connection between the electric wiring tape H1301 and the recording element substrate H1101 is performed by electric bonding of electroplated bumps formed on the electrode portions H1104 of the recording element substrate H1101 and the lead H1304 of the electric wiring tape H1301 by gang bonding.

As illustrated in FIG. 6B, the main body member H1501 functions as an ink tank by having spaces for independently holding the absorbing members H1601, H1602, and H1603 for generating negative pressure to hold the ink of each color therein. The main body member H1501 is also provided with ink supplying functions by forming independent ink channels for guiding each color ink to respective ink supply openings H1102 of the recording element substrate H1101. Compressed polypropylene (PP) fiber is used for the ink absorbing members H1601, H1602, and H1603, but compressed urethane fiber may be used. The filters H1701, H1702, and H1703 for preventing intrusion of foreign material into the recording element substrate H1101 are each bonded by fusing to boundary portions as to the ink absorbing members H1601, H1602, and H1603 upstream on the ink channels. For the filters H1701, H1702, and H1703, stainless steel mesh type filters can be used, but stainless steel metal fiber sintered type filters are more preferable.

Figure 7:
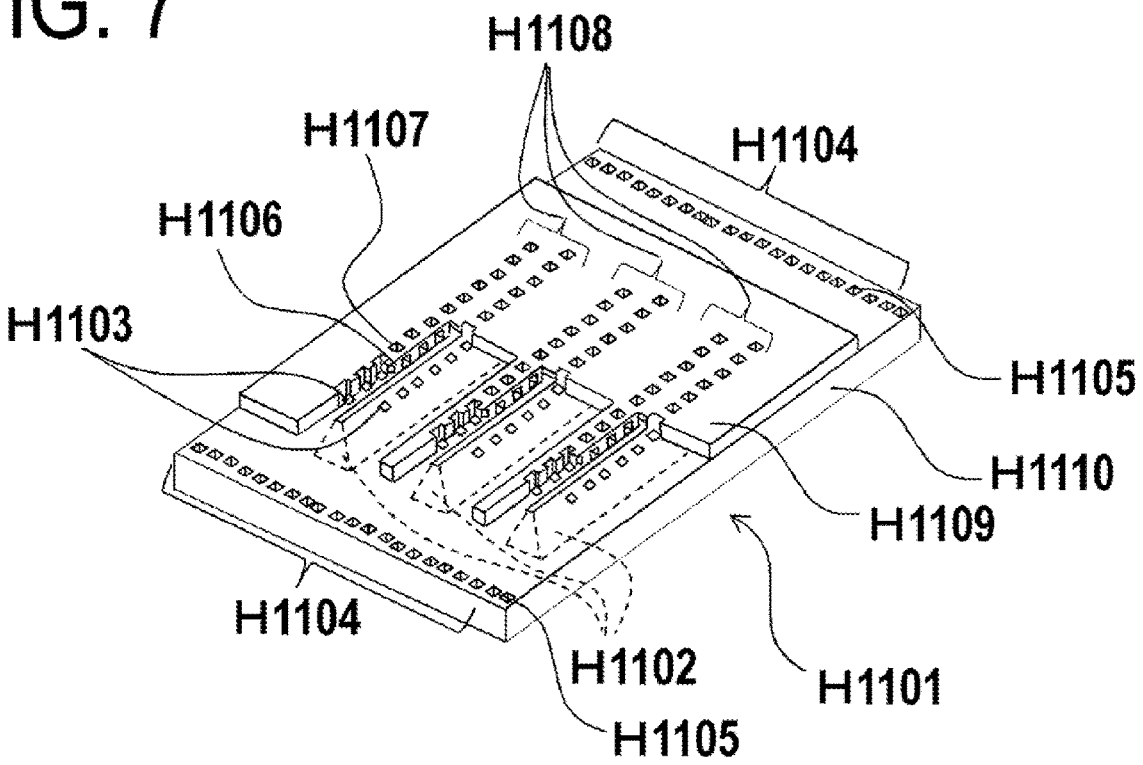
FIG. 7 is a partial cutaway perspective view of a recording element substrate.

FIG. 7 is a partial cutaway perspective view for describing the configuration of the recording element substrate H1101. The recording element substrate according to the present embodiment uses electrothermal conversion elements (energy generating elements) that generate thermal energy for causing film boiling in ink in accordance with electric signals. The recording element substrate according to the present embodiment is also an arrangement in which the electrothermal conversion elements and ink discharge orifices are arrayed facing each other, with ink being discharged in a direction perpendicular to a principal plane of the substrate (referred to as a side shooter type). As illustrated in FIG. 7, the recording element substrate H1101 has three slot-shaped ink supply openings H1102 formed in parallel for ink of the colors of cyan, magenta, and yellow, in a silicon (Si) substrate H1110. On both sides of each ink supply opening H1102 thereacross are provided one row each of electrothermal conversion elements H1103, with the electrothermal conversion elements among the rows being disposed shifted by ½ of the array pitch as to each other in the array direction, i.e., in the sub-scanning direction. A discharge orifice formation member H1109 is joined upon the recording element substrate H1101, with the electrothermal conversion elements and the discharge orifices being positioned, thereby configuring discharge portions H1108 for each of the colors. Note that ink channel walls H1106 and discharge orifices H1107 are formed in resin material of the discharge orifice formation member H1109 by photolithography technology.

Also, electric wiring for supplying electric power to the electrothermal conversion elements H1103, fuses, a logic circuit for driving the electrothermal conversion elements in accordance with recording data, the electrode portions H1104 for externally electrically connecting the portions, and so forth, are formed on the Si substrate H1110. Further, electroplated-bump-shaped electrode terminals H1105 of gold (Au) or the like are formed in the electrode portions H1104. Note that the electrothermal conversion elements H1103 and so forth can be formed using existing film formation technology.

Figure 8:
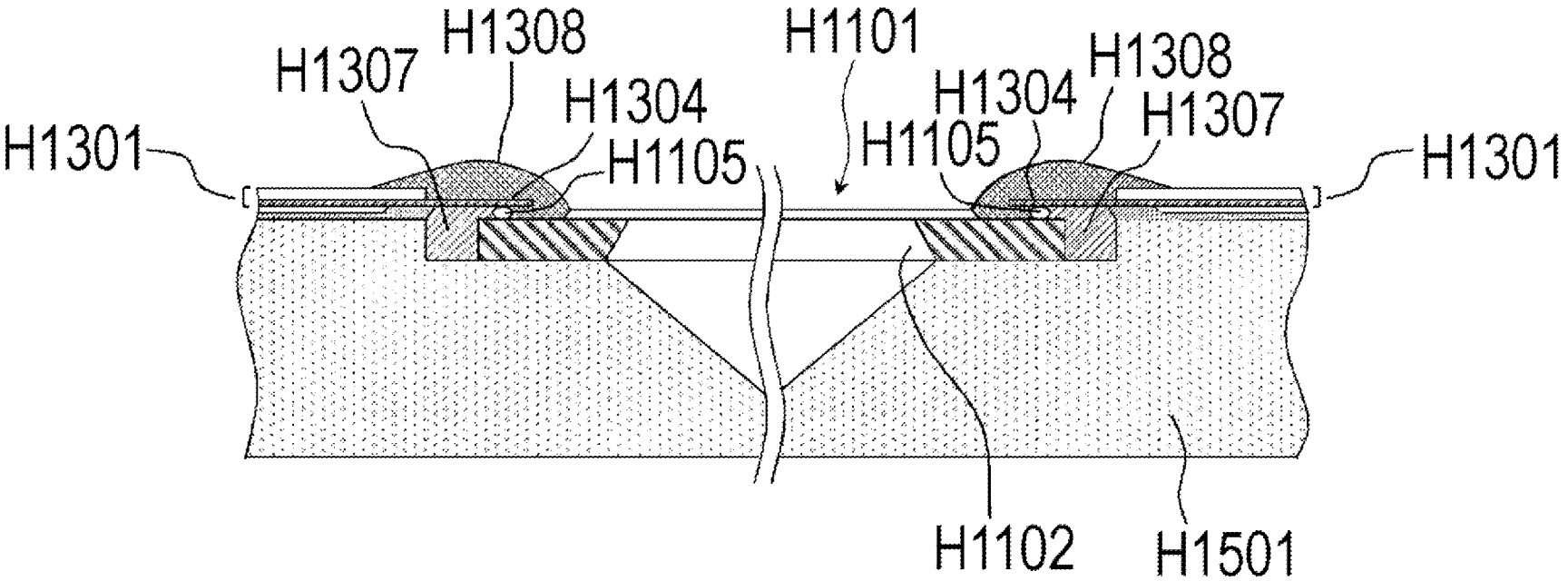
FIG. 8 is a partial cross-sectional view of a recording head, illustrating a sealed state of an electric bonding portion.

As illustrated in FIG. 8, the electric connection portion between the recording element substrate H1101 and the electric wiring tape H1301 is sealed by a first sealant H1307 and a second sealant H1308, thereby protecting the electric connection portion from corrosion by moisture from ink and so forth, and from external shock. The first sealant H1307 primarily seals the rear side of a connection portion of the lead H1304 of the electric wiring tape H1301 and the electrode terminal H1105 of the recording element substrate, and the peripheral portion of the recording element substrate, and the second sealant H1308 seals the front side of the electric connection portion.

Figure 1:
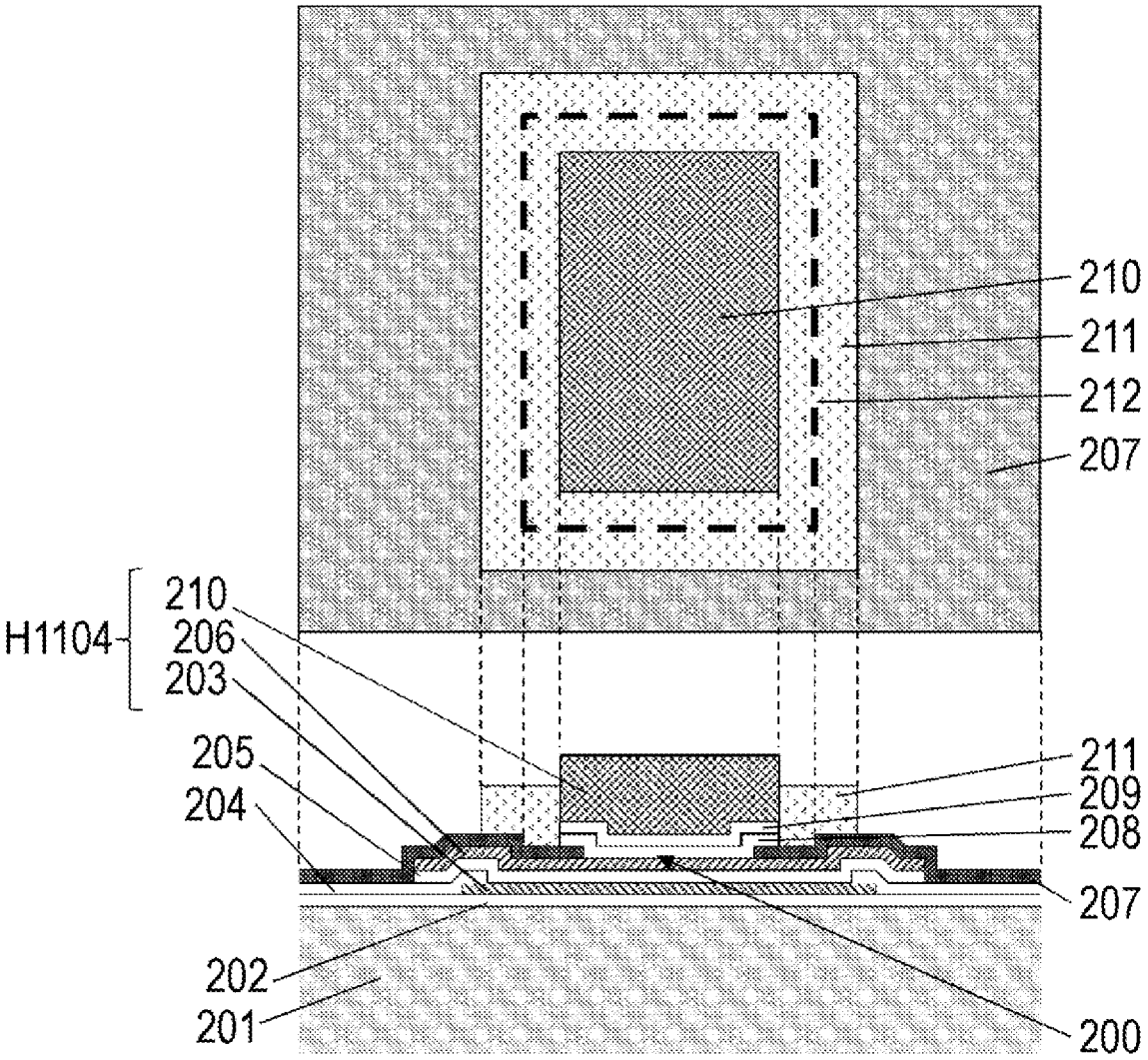
FIG. 1 is a schematic diagram of a cross-sectional view and top view of a substrate of an electrode terminal portion according to an embodiment of the present invention.

The configuration of the electrode terminals and bump portions on the element substrate for the recording head according to the present embodiment will be described. FIG. 1 is a schematic diagram of a cross-sectional view and top view of a substrate of an electrode terminal portion. A thermal storage layer 202, a first electric wiring film 203 that is circuit wiring, an interlayer insulating film layer 204, a heater layer 205 serving as energy generating elements, a second electric wiring film 206 that is circuit wiring, and a protective film layer (also referred to as a first protective film layer) 207 for protecting the circuit wiring, are sequentially formed on a substrate 201. These layers are a stacked structure made up of a plurality of film layers. Now, the first electric wiring film 203 and the second electric wiring film 206 are implemented in the stacked structure as circuit wiring for driving the heater layer 205. The interlayer insulating film layer 204 is formed covering the entire perimeter of the edge portion of the first electric wiring film 203. Now, the interlayer insulating film layer 204 is formed overlaying the entire perimeter of the edge portion of the first electric wiring film 203, and accordingly a stepped portion is formed between the portion formed upon the first electric wiring film 203 (overlapping portion) and portions otherwise. The film layers of the heater layer 205, the second electric wiring film 206, and the protective film layer 207 are then formed. Now, the second electric wiring film 206 is stacked upon the stepped portion formed in the interlayer insulating film layer 204, and accordingly has a protruding portion. The protective film layer 207 is formed thereupon, and accordingly the protective film layer 207 also has a protruding portion (protective film protruding portion). Further, an opening portion is provided in the protective film layer 207 by patterning, thereby forming a through hole 200 for external electric contact of the electric wiring. A thick metal film 210 that is a metal material for an electroplated bump layer is formed by electroplating on an electrode portion of part of the circuit wiring exposed from the through hole 200, with an adhesion improvement layer (barrier metal) 208 of a titanium-tungsten (TiW) alloy or the like formed as an electroplating ground layer and electroplating conductor gold 209 interposed therebetween. Due to such a stacked structure, a bent portion of the protective film layer 207 is formed at the periphery of the opening portion at which the electrode portion is exposed, by the protective film layer 207 covering the protruding portion that the second electric wiring film 206 has. Although the material of the substrate 201 is not limited in particular, a silicon substrate is preferably used from the perspective of thermal conductivity and so forth. Hereinafter, the substrate 201 will be described as being a silicon substrate 201.

Figure 9A:
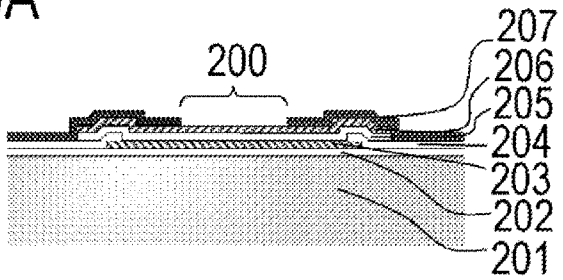
FIGS. 9A to 9E illustrate a conventional method of forming electroplated bumps.

Next, a conventional method of forming electroplated bumps will be described with reference to FIGS. 9A to 9E. Although the states of films of the electrode terminal in each of the steps are illustrated, it is needless to say that film structures over the entire substrate, such as the heater portion, the through hole portion, and so forth, are formed by several steps of the steps illustrated in FIGS. 9A to 9E at the same time. In FIG. 9A, an integrated circuit (IC) film layer (configured of around six layers, omitted from illustration) of a driver IC or the like, made up of a semiconductor element for driving the heater at the time of discharging ink, is formed on the silicon substrate 201. Also formed are a thermal storage layer 202 that is made of silicon dioxide ($SiO_2$), and the first electric wiring film 203 that is made of aluminum, making up a common electrode for supplying electric source power in driving the heater by the driver IC in accordance with drive signals, or a common electrode for grounding. The interlayer insulating film layer 204 made of silicon monoxide (SiO) is formed covering the entire perimeter of the edge portion of the first electric wiring film 203, and has a portion overlapping the electric wiring film 203 (overlapping portion). Note that the overlapping portion is formed in an annular form following the entire perimeter of the edge portion of the electric wiring film 203. Thereafter, the heater layer 205 is formed over a region straddling above the electric wiring film 203 and the overlapping portion of the interlayer insulating film layer 204, as a heat generating resistance film layer making up the heater. The second electric wiring film 206 made up aluminum for supplying electric power to the heater by being directly connected thereto, the protective film layer 207 made of brittle materials such as silicon nitride (SiN), silicon carbide (SiC), and so forth, for protecting the wiring and the heater, are formed in order. The protective film is then patterned by photolithography technology, thereby forming the through hole 200 for external electric contact of the aluminum circuit wiring.

Figure 9B:
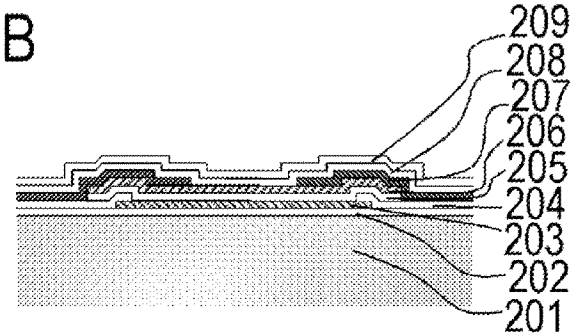
Figure 9C:
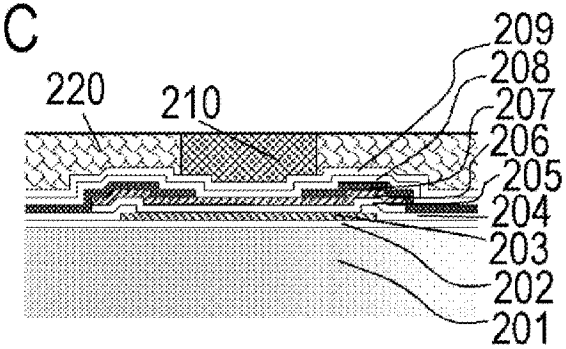
Figure 9D:
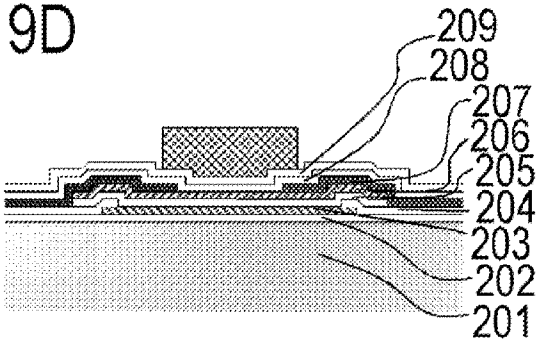
Figure 9E:
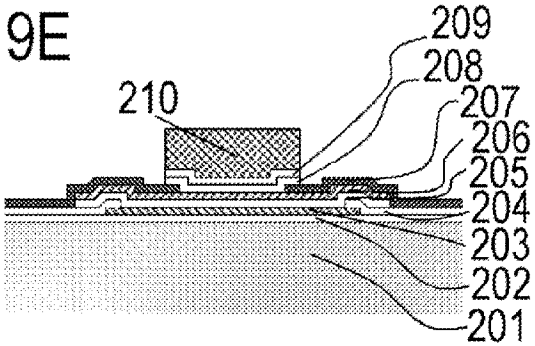

As illustrated in FIG. 9B, the adhesion improvement layer 208 of TiW, which is a high-melting-point metal material, is formed over the entire face to a predetermined thickness, by a vacuum film forming apparatus or the like. Film formation of the electroplating conductor gold 209 that is an excellent wiring material is performed over the entire face to a predetermined thickness, by a vacuum film forming apparatus or the like. A negative resist 220 is coated on the surface of the electroplating conductor gold in FIG. 9C by spin coating for example, and the resist is exposed and developed by photolithography. Thereafter, applying a predetermined current to the electroplating conductor gold by electroplating causes precipitation of gold at predetermined regions not covered by the resist, thereby forming the thick metal film 210 to serve as a bump on the inner side of the resist. In FIG. 9D, the article is immersed in a resist removing agent for a predetermined amount of time to remove the resist and expose the electroplating conductor gold, following which the electroplating conductor gold is immersed in an etchant of iodine+potassium iodide containing a nitrogen-based organic compound for a predetermined amount of time, thereby exposing the adhesion improvement layer 208. In FIG. 9E, the adhesion improvement layer 208 is immersed in a hydrogen peroxide ($H_2O_2$) based etchant for a predetermined amount of time, thereby forming the electroplated bump for supplying driving power to the aluminum electric wiring from a gold plating layer formed of the electroplating conductor layer (electroplating step). Note that the adhesion improvement layer 208, the electroplating conductor gold 209, and the thick metal film 210 are formed overlapping over the entire perimeter of the edge portion of the protective film layer 207.

Figure 10:
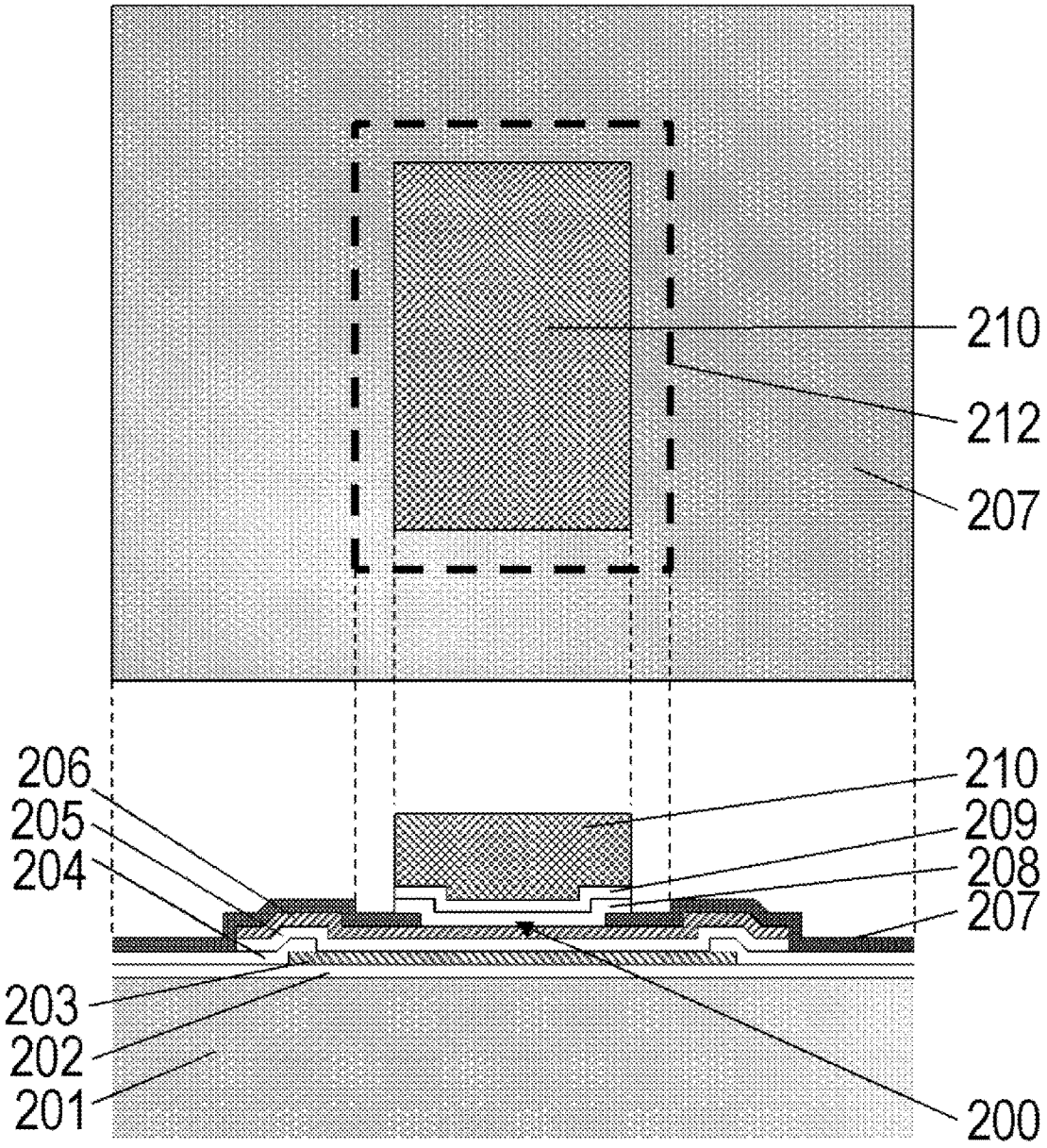
FIG. 10 is a schematic diagram of a cross-sectional view and top view of a substrate of a conventional electrode terminal portion.

However, in the conventional bonding method in which the electroplated bump and lead are electrically connected, applying the pressure to the electroplated bump using a bonding tool sometimes damaged the bent portion of the protective film layer on the outer side of the electroplated bump (portion 212 in FIG. 10), causing cracks.

The process of the protective film layer being damaged and cracks occurring will now be described. The bonding tool applies a load (shock load, pressing load) to the electroplated bump via the lead for electric bonding of the electroplated bump and the lead. The lead and the electroplated bump are crushed by the pressing force applied to the electroplated bump by the bonding tool. Further, the first and second electric wiring layers made of aluminum formed beneath the electroplated bump directly under the lead are also crushed by the pressing force applied to the electroplated bump by the bonding tool. Materials harder than aluminum are used for the thermal storage layer formed below the first electric wiring film and for the silicon substrate, and accordingly these are not crushed under the load applied to the electroplated bump by the bonding tool.

The electroplated bump and the first and second electric wiring films crushed by the pressing force applied to the electroplated bump by the bonding tool will move to the protective film layer side on the outer side of the region where the crushing occurred. At this time, the protective film layer that is formed on the upper side of the second electric wiring film and on the lower side of the electroplated bump, and that adheres to the second electric wiring film and the electroplated bump also moves along with the movement of the second electric wiring film and the electroplated bump. As a result, stress is concentrated at the bent portion of the protective film layer on the outer side of the edge of the electroplated bump, and cracks occur in the protective film layer. In a case of increasing the pressing force at the time of bonding to prevent electric connection defects, such as peeling, fracturing, and so forth, the size and number of cracks occurring in the protective film layer tend to increase.

When cracks are formed at the bent portion of the protective film layer, a problem occurs in that moisture from ink and so forth enters from the cracks, and the electric wiring film made up of aluminum, which was covered by the protective film layer, is corroded. Although a sealant is coated on the electric connection portion in order to protect the electric connection portion from moisture from ink and so forth in the manufacturing process of the recording head, there is a possibility that moisture absorbed by the sealant will enter from the cracks, and cause corrosion of the electric wiring film.

Accordingly, a feature of the present embodiment is that following formation of the thick metal film 210, a resin film layer 211 (elastic resin film) is formed as a second protective film layer, so as to cover the bent portion 212 of the protective film layer 207 on the outer side of the edge of the electroplated bump. When the bent portion 212 of the protective film layer 207 is exposed as in conventional electrode terminal configurations, cracks sometimes occurred at the bent portion of the protective film layer on the outer side of the electroplated bump at the time of batch bonding of the leads to the electroplated bumps on the electrode terminals by gang bonding. However, according to the configuration of the present embodiment, even when cracks are formed at the bent portion of the protective film layer, the cracked portions are protected by the resin film layer 211 that is the second protective film layer. Accordingly, the problem of moisture from ink and so forth, and moisture absorbed by the sealant applied to protect the electric connection portion, entering from the cracks and causing corrosion of the aluminum wiring covered by the protective film layer, can be prevented.

Figure 2A:
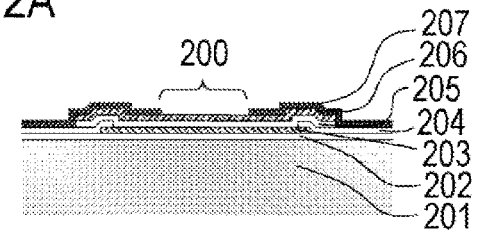
FIGS. 2A to 2I illustrate a method of forming electroplated bumps and a resin film layer according to the embodiment of the present invention.
Figure 2B:
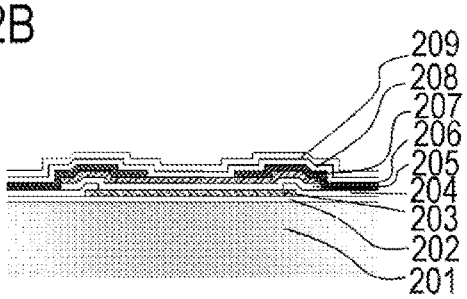
Figure 2C:
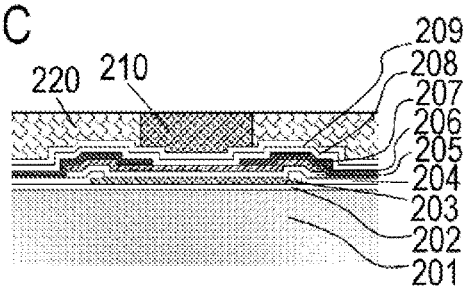
Figure 2D:
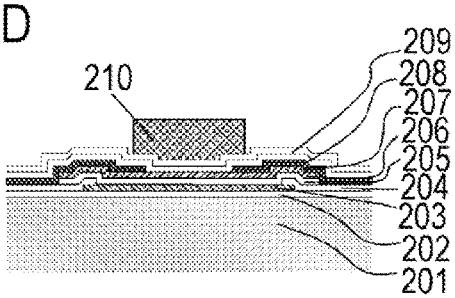
Figure 2E:
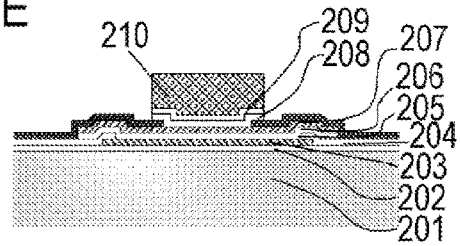
Figure 2F:
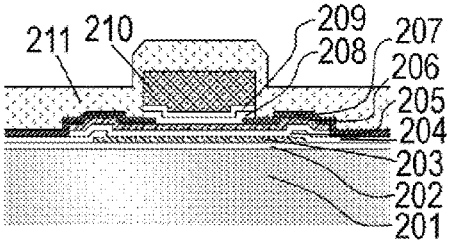
Figure 2G:
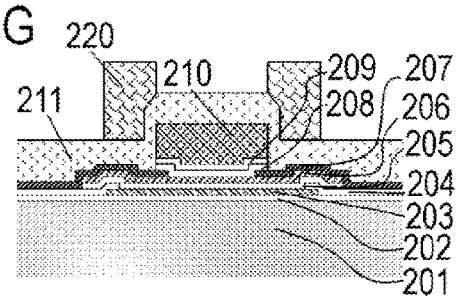
Figure 2H:
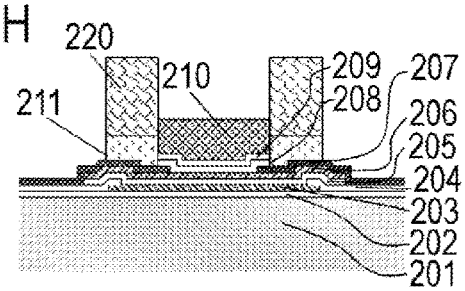
Figure 2I:
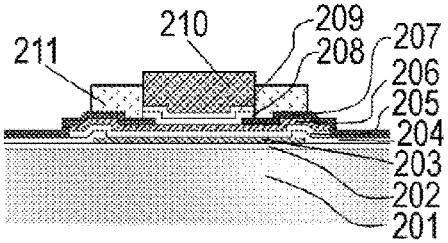

A manufacturing method of the electrode terminal having the configuration of the present embodiment will be described with reference to FIGS. 2A to 21. FIGS. 2A to 2E, which are stacking steps, are the same as the steps described earlier, and accordingly description will be omitted. FIGS. 2F to 21, which are features of the present embodiment, will be described here. In FIG. 2F, the surface of the protective film layer 207 is coated with the resin film layer 211 by spin coating, and thermal setting of the resin film layer 211 is performed. Examples of materials that can be used for the resin film layer 211 include polyether amide resin, acrylic resin, cyclized rubber, epoxy resin, and so forth. In FIG. 2G, the negative resist 220, for example, is coated on the surface of the resin film layer 211 by spin coating, and the resist is exposed and developed by photolithography. In FIG. 2H, the resin film layer is removed by etching from regions other than the resin film layer 211 covering the bent portion of the protective film layer 207 on the outer side of the edge of the electroplated bump. In FIG. 2I, the article is immersed in a resist removing agent for a predetermined amount of time to remove the resist 220 (protective film forming step). In this way, forming the resin film layer 211 as the second protective film layer enables the resin film layer 211 to be formed at the bent portion of the protective film layer 207, and moisture from ink or the like can be prevented from intruding into cracks even if cracks occur in the protective film layer 207.

FIG. 8 is a partial cross-sectional view of a recording head, illustrating the sealed state of the electric bonding portion according to the present embodiment. As illustrated in FIG. 8, the electric connection portion of the recording element substrate H1101 and the electric wiring tape H1301 is sealed by the first sealant H1307 and the second sealant H1308, in order to protect from corrosion by ink and external shock. The first sealant H1307 primarily seals the rear side of the connection portion of the lead H1304 of the electric wiring tape H1301 and the electrode terminal H1105 of the recording element substrate, and the peripheral portion of the recording element substrate, and the second sealant H1308 seals the front side of this connection portion. While the second sealant H1308 is coated on the protective film layer in the conventional electrode terminal configuration, the second sealant H1308 is coated on the protective film layer 207 and on the resin film layer 211 in the configuration according to the present embodiment. The adhesion of the protective film layer 207 and the second sealant H1308 is great as compared to the adhesion of the resin film layer 211 and the second sealant H1308, and accordingly the second sealant H1308 coated on the protective film layer 207 does not flow as easily as compared to a case of being coated on the resin film layer 211. As a result there is a possibility that sufficient protection of the electric connection portion by the sealant may not be obtained. Alternatively, increased height of the sealant from the recording element substrate may affect conveying of the recording medium at the image recording portion. Accordingly, in the configuration according to the present embodiment, the formation region of the resin film layer (elastic resin film) is preferably limited in order to avoid the above concerns due to lower flowability of the second sealant.

Second Embodiment

Figure 3A:
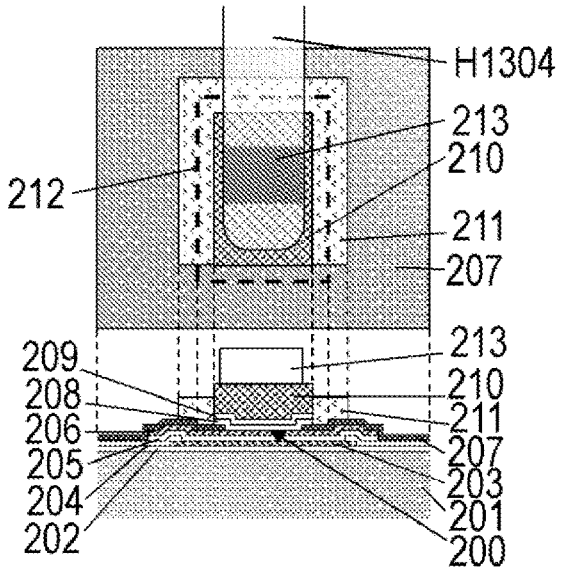
FIGS. 3A to 3C illustrate a formation region of the resin film layer according to the embodiment of the present invention.
Figure 3B:
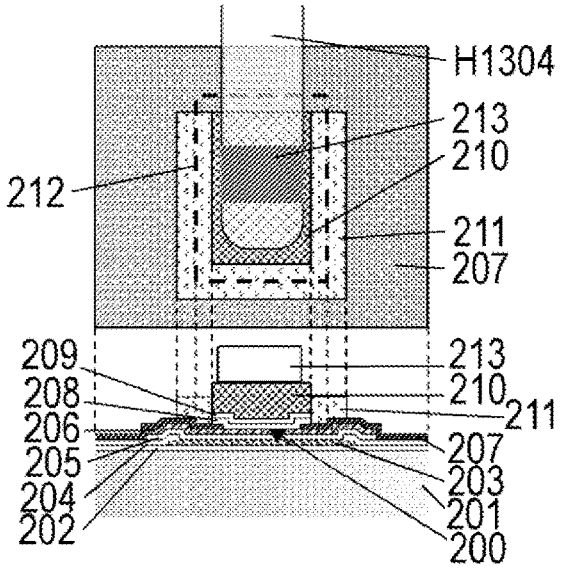
Figure 3C:
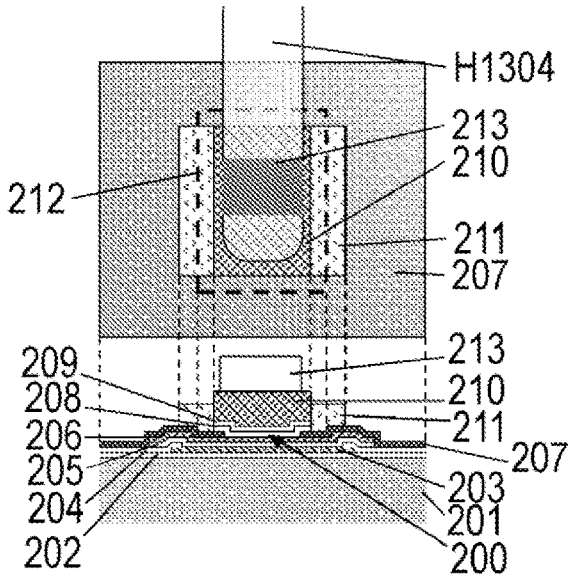

In the first embodiment, the formation region of the resin film layer 211 annularly covers the entire region of the bent portion of the protective film layer 207, as illustrated in FIG. 1. In the present embodiment, the formation region of the resin film layer 211 may be formed on the electroplated bump layer in the shape of the letter U, as illustrated in FIGS. 3A and 3B. Alternatively, the resin film layer 211 may be formed on at least the bent portion of the protective film layer in close proximity to a thermocompression bonding portion 213 for when performing gang bonding, as illustrated in FIG. 3C.

Third Embodiment

Now, there is a bonding step in which a discharge orifice formation member (channel formation member), in which ink channel walls and discharge orifices are formed, is positioned and bonded upon the recording element substrate. In order to increase adhesion at the time of bonding, an adhesion improvement layer is sometimes provided on the recording element substrate. In the present embodiment, this adhesion improvement layer is used as the second protective film layer. That is to say, the adhesion improvement layer is formed on the bent portion of the protection film layer. According to this arrangement, increase in the number of steps by separately disposing the resin film layer as in the first and second embodiments can be prevented.

As described above, according to the configuration of the present embodiment, even though cracks may be formed at the bent portion of the protective film layer at the time of electric bonding of the recording element substrate and the lead by gang bonding, the resin film layer covers and protects the crack portions. Accordingly, the problem of moisture from ink or the like intruding from the cracks and corroding the aluminum wiring covered by the protective film layer can be prevented, and also deterioration in electric reliability and trouble when printing can be prevented. Note that while a case of performing gang bonding has been described in the present embodiment, it is needless to say that the present invention is effective in a case of performing single-point bonding as well.

Also, in the present invention, the manufacturing process of the ink jet recording head may be carried out by with the step of electrically connecting the recording element substrate and the electric wiring substrate first, or by first individually fixing each of the recording element substrate and the electric wiring substrate to a base member, and thereafter performing electric connection of the two.

Further, in the present embodiment, an example is described in which the present invention is applied to the configuration of a color recording head that discharges ink of the three colors of cyan, magenta, and yellow. However, it is needless to say that the same configuration can be used with a black ink recording head. It also goes without saying that the types and numbers of color tones (colors and tones) of the ink used in the recording head can be decided as appropriate.

In addition, a case of applying the present invention to a recording head in which the ink storage portion is inseparably integrated has been exemplified in the present embodiment. However, from the perspective of reduction of the load on electrode terminals, protective layers, and so forth, application may be made to a recording head form in which the ink tank is separably integrated, or in which the ink tank is separate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-064778, filed on Apr. 6, 2021, which is hereby incorporated by reference herein in its entirety.

What is claimed is:

1. An element substrate used in a liquid discharge head that discharges liquid to a recording material, the element substrate comprising:

a substrate;

an energy generating element that generates energy used to discharge the liquid;

circuit wiring that has an electrode portion for external electrical connection and that drives the energy generating element, and that is implemented on the substrate;

a first protective film layer that has an opening portion for exposing the electrode portion and that covers the circuit wiring;

an electroplating ground layer formed on the electrode portion; and an electroplated bump layer made of a metal material formed on the electroplating ground layer, wherein a bent portion is formed in the first protective film layer by the first protective film layer covering a protruding portion that the circuit wiring has, and a second protective film layer is formed on the first protective film layer and covers the bent portion.

2. The element substrate according to claim 1, wherein the circuit wiring has a stacked structure made up of a plurality of film layers, and is implemented on the substrate with a thermal storage layer interposed therebetween, the energy generating element is a heat generating resistance film layer included in the stacked structure, the stacked structure includes:

a first electric wiring film formed on the thermal storage layer;

an interlayer insulating film layer that has an overlapping portion overlapping on an edge portion of the first electric wiring film, and that is formed on the thermal storage layer;

the heat generating resistance film layer that is formed straddling on the first electric wiring film and on a region including the overlapping portion of the interlayer insulating film layer; and a second electric wiring film formed on the heat generating resistance film layer, wherein the overlapping portion is annularly formed along an entire perimeter of the edge portion of the first electric wiring film, and the heat generating resistance film layer and a portion of the second electric wiring film overlapping on the overlapping portion form the protruding portion of the circuit wiring.

3. The element substrate according to claim 2, wherein the bent portion is annularly formed corresponding to the annular protruding portion, and the second protective film layer is formed on the first protective film layer covering, of the annular bent portion, at least a region parallel to a direction in which a lead bonded on the electroplated bump layer extends.

4. The element substrate according to claim 3, wherein the bent portion is annularly formed corresponding to the annular protruding portion, and the second protective film layer is formed on the first protective film layer covering, of the annular bent portion, at least a region in close proximity to a thermocompression bonding portion between the electroplated bump layer and the lead.

5. The element substrate according to claim 1, wherein the electroplating ground layer is formed on the electrode portion, having a portion overlapping above an entire perimeter of an edge portion of the opening portion of the first protective film layer.

6. The element substrate according to claim 1, wherein the first protective film layer has a protective film protruding portion formed corresponding to the protruding portion of the circuit wiring, and the bent portion is a bent portion formed at a side of the protective film protruding portion near to the electroplating ground layer.

7. The element substrate according to claim 1, wherein the second protective film layer is a resin film layer.

8. The element substrate according to claim 7, wherein a material of the resin film layer is a polyether amide resin, an acrylic resin, a cyclized rubber, or an epoxy resin.

9. The element substrate according to claim 1, further comprising:

a channel formation member that is bonded on the first protective film layer and that forms a channel for liquid in the liquid discharge head, wherein the second protective film layer is an adhesion improvement layer for improving adhesion between the first protective film layer and the channel formation member.

10. A liquid discharge head that discharges liquid to a recording material comprising:

an element substrate including a substrate, an energy generating element that generates energy used to discharge the liquid, circuit wiring that has an electrode portion for external electrical connection and that drives the energy generating element, and that is implemented on the substrate, a first protective film layer that has an opening portion for exposing the electrode portion and that covers the circuit wiring, an electroplating ground layer formed on the electrode portion, and an electroplated bump layer made of a metal material formed on the electroplating ground layer, in which element substrate a bent portion is formed in the first protective film layer by the first protective film layer covering a protruding portion that the circuit wiring has;

a relay wiring portion provided with a lead connecting to the electrode portion; and a casing that internally stores the liquid to be supplied to the element substrate, wherein a second protective film layer is formed on the first protective film layer and covers the bent portion on the element substrate.

11. A manufacturing method of an element substrate used in a liquid discharge head that discharges liquid to a recording material, the element substrate including a substrate, an energy generating element that generates energy used to discharge the liquid, circuit wiring that has an electrode portion for external electrical connection and that drives the energy generating element, and that is implemented on the substrate, a first protective film layer that has an opening portion for exposing the electrode portion and that covers the circuit wiring, an electroplating ground layer formed on the electrode portion, an electroplated bump layer made of a metal material formed on the electroplating ground layer, and a bent portion formed on the first protective film layer by the first protective film layer covering a protruding portion that the circuit wiring has, the manufacturing method of the element substrate comprising the steps of:

stacking, of forming a stacked structure of the circuit wiring made up of a plurality of film layers including the energy generating element on the substrate, and covering the circuit wiring by the first protective film layer with the electrode portion exposed from the opening portion;

electroplating, of forming the electroplating ground layer on the electrode portion, and forming the electroplated bump layer on the electroplating ground layer by electroplating; and protective film forming, of forming, following the electroplating, a second protective film layer that covers a bent portion, formed at a periphery of the opening portion of the first protective film layer by a protruding portion that the circuit wiring has, being covered by the first protective film layer in the stacking.

12. The manufacturing method of the element substrate according to claim 11, wherein in the stacking, the circuit wiring is implemented on the substrate with a thermal storage layer interposed therebetween, the energy generating element is a heat generating resistance film layer included in the stacked structure, the stacking includes, with regard to the stacked structure, the steps of forming a first electric wiring film on the thermal storage layer, forming an interlayer insulating film layer that has an overlapping portion overlapping on an edge portion of the first electric wiring film in an annular form following the entire perimeter of the edge portion of the first electric wiring film, on the thermal storage layer, forming the heat generating resistance film layer straddling on the first electric wiring film and on a region including the overlapping portion of the interlayer insulating film layer, and forming a second electric wiring film on the heat generating resistance film layer, wherein the protruding portion is formed by a portion of the heat generating resistance film layer and the second electric wiring film overlapping on the overlapping portion.

* * * * *